US005442126A

United States Patent [19]

Tokiharu

[11] Patent Number: 5,442,126

[45] Date of Patent: Aug. 15, 1995

[54] MUSICAL SOUND SIGNAL RECORDING/REPRODUCING APPARATUS

[75] Inventor: Ando Tokiharu, Hamamatsu, Japan

[73] Assignee: Yamaha Corporation, Japan

[21] Appl. No.: 90,756

[22] Filed: Jul. 13, 1993

[30] Foreign Application Priority Data

Jul. 16, 1992 [JP] Japan ..... 4-189324

[51] Int. Cl.[6] ..... G10H 7/04; G10H 7/12

[52] U.S. Cl. ..... 84/603; 84/604

[58] Field of Search ..... 84/601-607, 84/615, 617, 622, 647

[56] References Cited

U.S. PATENT DOCUMENTS 4,279,186 7/1981 Deforeit ..... 84/1.01
4,402,243 9/1983 Deforeit ..... 84/1.01
4,461,199 7/1984 Hiyoshi et al. .
5,252,773 10/1993 Kozuki et al. ..... 84/607
5,262,581 11/1993 Sharp ..... 84/603
5,360,724 4/1994 Medovich ..... 84/604

*Primary Examiner*—Vit W. Miska
*Attorney, Agent, or Firm*—Graham & James

[57] ABSTRACT

A musical sound signal recording/reproducing apparatus, which records/reproduces a musical sound signal having a waveform, includes a rewritable waveform memory and an address translator. The rewritable waveform memory stores waveform data of musical sound signals. The rewritable waveform memory is accessed with real addresses to write, read, delete, and edit the waveform data. The address translator translates consecutive virtual addresses supplied thereto into the real addresses. Therefore, the apparatus accesses the rewritable waveform memory with consecutive virtual addresses instead of the real addresses which are consecutively or discretely arranged.

16 Claims, 12 Drawing Sheets

BCT

| | | |
|---|---|---|
| 255 | &H00 | |
| ⋮ | ⋮ | |
| 11 | 12 | |
| 10 | &H00 | W3 |
| 9 | 10 | W3 |
| 8 | 9 | W3 |
| 7 | 8 | W3 |
| 6 | 11 | |
| 5 | 6 | |
| 4 | 5 | |
| 3 | &H00 | W1 |
| 2 | 3 | W1 |
| 1 | 2 | W1 |
| 0 | 1 | W1 |

MUSICAL SOUND SIGNAL RECORDING/REPRODUCING APPARATUS

BACKGROUND OF THE INVENTION

1. Field of the Invention

The present invention relates to a musical sound signal recording/reproducing apparatus if which desired musical sound signals are recorded and the recorded musical sound signals are reproduced in response to the depression of corresponding key on the keyboard.

2. Prior Art

One such conventional apparatus is disclosed in U.S. Pat. No. 4,4461,199, where analog waveforms of musical sounds are sampled at predetermined intervals to be converted into digital data representative of the time varying amplitudes of the waveforms, The digital data is then stored in a memory of the apparatus hereinafter referred to as a waveform memory. This apparatus is designed such that a plurality of waveform data representative of musical sounds with different tones can be stored in the waveform memory and the stored waveform data can be read from the waveform memory according to the pitch and tone information input from the keyboard.

With the aforementioned musical sound recording-/reproducing apparatus, when a large number of different waveform data are stored in the waveform memory, a sufficient storage area may not be available for future storage of new waveforms. In such cases, the waveform data for unnecessary sounds is usually erased from waveform memory to increase the storage area for the new waveforms leaving non-consecutive available areas of waveform memory as shown FIG. 14A.

The amount of waveform data depends on the length of time a musical sound is recorded and therefore there may not be enough memory to store a new waveform. Waveform data for one instrument is located in consecutive addresses of the waveform memory and the waveform memory is divided up into different blocks with waveform data for different instruments. For this reason, conventionally, when waveform data of a particular instrument is deleted from the waveform memory, all the waveform data stored in waveform memory is rewritten so that all the waveform data is relocated to lower consecutive addresses as shown in FIG. 14B, and the size of the available area of waveform memory is increased. This kind of data processing is, however, time consuming.

SUMMARY OF THE INVENTION

An object of the present invention is to provide a musical sound recording/reproducing apparatus with rewritable waveform memory accessible from consecutive addresses with the ability to write musical sound signals into and read the musical sound signals from the waveform memory. Another object of the invention is to provide a musical sound recording/reproducing apparatus in which a new waveform data is written into the waveform memory without having to relocate the waveform data in the waveform memory.

In the present invention, virtual addresses are used to access a rewritable waveform memory to write waveform data of musical sound signals thereinto, to read waveform data of musical sound signals therefrom, and to delete desired waveform data of musical sound signals therefrom. Address translating means translates consecutive virtual addresses supplied thereto into real addresses. These real addresses are used to actually access the rewritable waveform memory.

BRIEF DESCRIPTION OF THE DRAWINGS

Features and other objects of the invention will become more apparent from the description of the preferred embodiments with reference to the accompanying drawings in which.

DETAILED DESCRIPTION OF THE PREFERRED EMBODIMENT

Operation

Waveform data is written into and read from the waveform memory RAM 2 at consecutive addresses. This consecutive addresses are virtual addresses which are translated by an address translator 7 into real addresses, which in turn are used to actually address the waveform memory RAM2. Therefore, the real addresses of the waveform data can be represented with consecutive virtual addresses even if the waveform data for a musical sound is stored at addresses not consecutively located in the waveform memory RAM 2.

Construction

Figure 1:
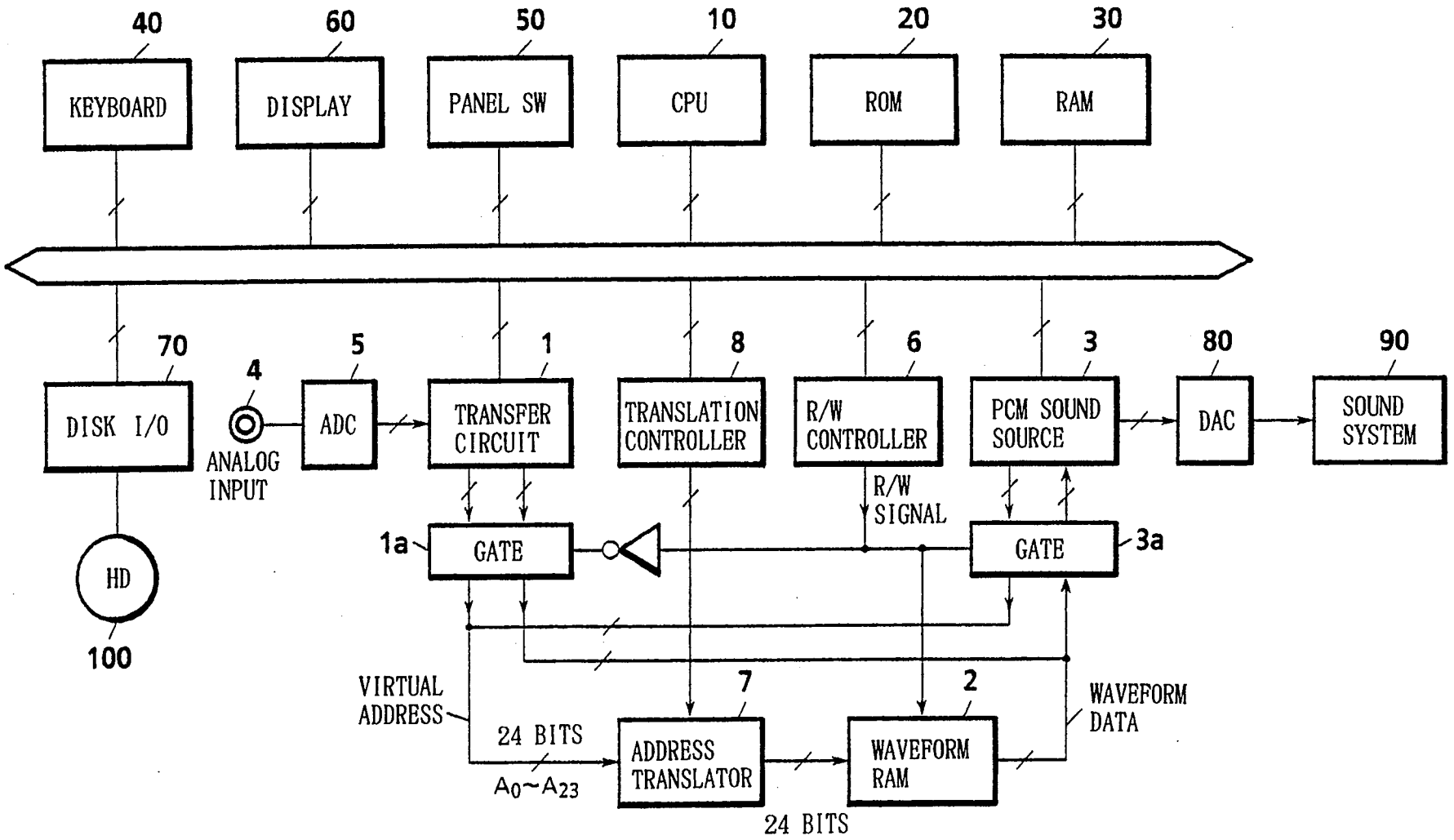
FIG. 1 is a block diagram illustrating a musical sound signal recording/reproducing apparatus according to the present invention.

FIG. 1 is a block diagram showing an electronic musical instrument to which the present invention is applied. A CPU 10 uses the working area of a RAM 30 to perform the control of the whole electronic musical instrument according to a control program stored in a ROM 20. When the apparatus is in the record mode, the CPU 10 writes waveform data into waveform RAM 2 via a transfer circuit 1. When in the reproduction mode the apparatus reads the waveform data from the waveform RAM 2 via a PCM sound source 3 in response to the depression of a key on the keyboard 40.

The panel switch 50 includes a selector switch used to select the record mode, reproduction mode, or the erasure and rearrangement of waveform data. Waveform-number switches are used to select the waveform data of a particular instrument according to a waveform number to be reproduced or to be erased. Operation of the CPU 10 is based on the selected switch positions with a display 60 to display the selected waveform numbers when erasing waveform data from the waveform memory or when rearranging the waveform data in the waveform memory.

When the apparatus is operated in the record mode, an analog acoustic sound signal is input through an input device such as a microphone into an analog input terminal 4. An A/D converter 5 samples the analog acoustic sound signal at a predetermined sampling rate, for example, 50 kHz and converts the analog signal into waveform data with a predetermined number of bits, e.g., 12 bits. The waveform data representing the tone information for the corresponding waveform number is written via the transfer circuit 1 into the waveform RAM 2. Waveforms which are input from a mass storage device such as a hard disk 100 are input via a disk I/O 70 under control of the CPU 10 and are also stored into the waveform RAM 2.

In the reproduction mode, the PCM sound source 3 reads the desired waveform data from the waveform RAM 2 according to the currently selected waveform number and a key code unique to a depressed key. The PCM sound source 3 then outputs the desired waveform data to a D/A converter 80. The D/A converter 80 converts the waveform data from digital form into an analog electronic signal and this signal is output to a sound system 90 including sound components such as amplifiers and loud speakers. The PCM sound source 3 can also be set to the read mode when the waveform RAM 2 is read by the CPU 10 via the PCM sound source 3 and output to the hard disk 100 via the disk I/O 70 and stored for retrieval later.

The CPU 10 sends a write command to the transfer circuit 1 and R/W controller 6 when in the record mode, and a read command to the PCM sound source 3 and R/W controller 6 when in the reproduction mode. When the R/W controller 6 receives a command from the CPU, it pulls the R/W signal low to set the waveform RAM 2 to the write mode, and forces the R/E signal high to set the waveform RAM 2 to the read mode, depending on the command sent by the CPU 10. The R/W signal opens gate 1*a* and closes gate 3*a* in the write mode, and closes gate 1*a* and opens gate 3*a* in the read mode.

When the invention is operated in the record mode, the waveform RAM 2 is in the write mode where the transfer circuit 1 receives waveforms from the A/D converter or the disk I/O 70 and outputs the waveforms to the waveform RAM 2 via the gate 1*a*. Simultaneously, the transfer circuit 1 also sends sending consecutive virtual addresses, which are used to address the waveform RAM 2, to an address translator 7 via the gate 1*a*. The address translator 7 translates the received virtual addresses into real addresses by means of a later described translation table. The translated real addresses are then used to address the waveform RAM 2 so that the waveforms from the transfer circuit 1 are stored in consecutive memory positions.

When the invention is in the reproduction mode, the waveform RAM 2 is in the read mode where the PCM sound source 3 generates consecutive virtual addresses which are output to the address translator 7 via gate 3*a*. The virtual addresses are converted to real addresses by the address translator 7 and these are used to address the memory positions so that the desired waveform data can be read into the PCM sound source 3 via gate 3*a*.

Structure of Virtual Block

Figure 3:
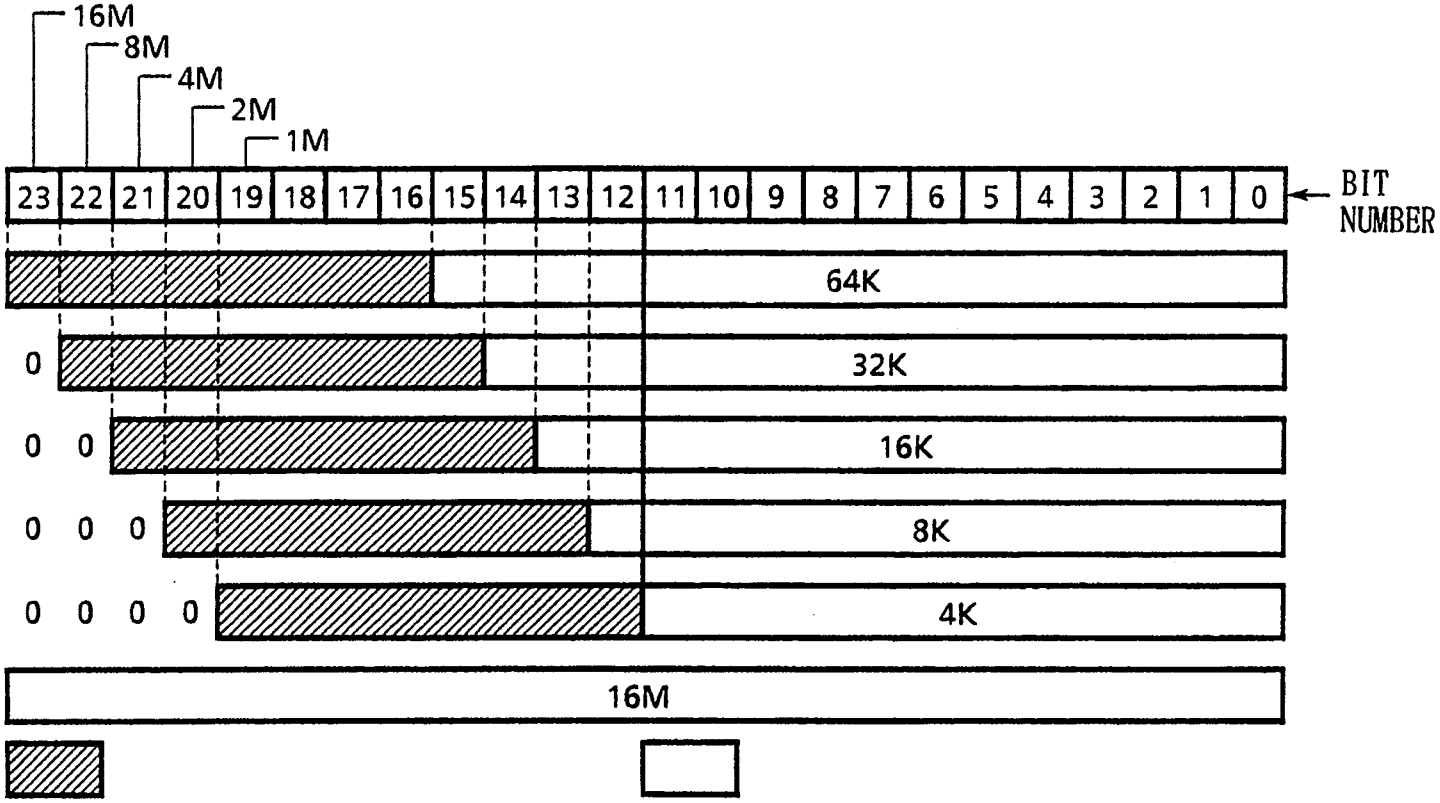
FIG. 3 illustrates the structure of block addresses of the embodiment according to the present invention.

The waveform RAM 2 is a 16 M-word memory that is addressed from 24-bit addresses. In the embodiment of the present invention, as shown in FIG. 3, eight bits (hatched portions) out of 24-bits are used as a block address, defining a total of 256 blocks in the real address area of the waveform RAM 2. The transfer circuit 1 and the PCM sound source 3 access the waveform RAM 2 with a 24-bit virtual address including an 8-bit block address which is translated into a real address by the address translator 7 and the 16 remaining bits are used as a real address so that the waveform RAM 2 is actually accessed with a 24-bit real address.

The diagram shown in FIG. 3 illustrates the different possible format for the virtual address. According to the example shown in FIG. 5, the size of the virtual address can vary between 20 bits and 24 bits, accessing a total available memory of between 1 M-words and 16 M-words. The number of blocks is determined by the size of the block address. In this example, the block address contains eight bits allowing for 256 different blocks with a range between 0 and 256. The size of the total available memory is dictated by the size of the block. The size of these blocks varies between 4 k-words and 64 k-words corresponding to a total available memory of between 1 M-words and 16 M-words, respectively.

When less than 24 bits are used and the block size is below 64 k, the higher bit(s) not used by the block address are set to a logic 0, so that the value (referred to as block number hereinafter) of any block address is a value in the range from 0 to 255. In the embodiment of the present invention, an operation mode of an electronic musical instrument may also be selected where address translation is not performed by the address translator 7. In this configuration, the waveform RAM 2 has only one block with an address capacity of 16M.

As illustrated in FIG. 1, a translation controller 8 consisting of a group of registers and receives various control signals and data from the CPU 10 and latches these signals and data to input them into the address translator 7. The address translator 7 includes a rewritable translation table which translates the value of a virtual address, referred to as virtual block number hereinafter, into the value of a real address, referred to as real block number hereinafter. The CPU 10 sends control signals and data and writes them into the translation table.

Address translator and Translation Controller

Figure 2:
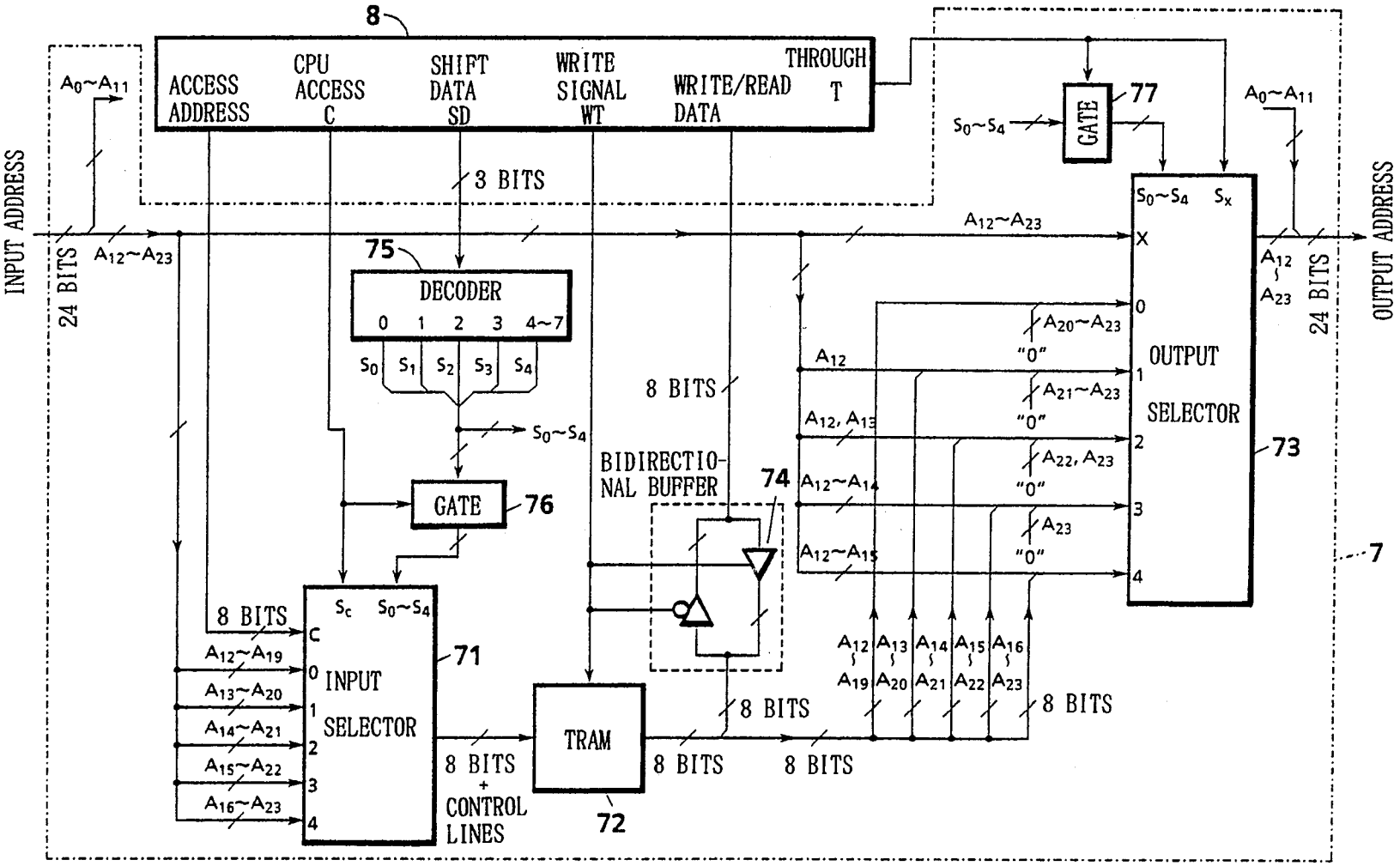
FIG. 2 is a schematic diagram showing the address translator and address translation controller of an embodiment of the invention.

FIG. 2 illustrates the address translator 7 and translation controller 8 in detail. The address translator 7 includes an input selector 71, TRAM 72, output selector 73, bidirectional buffer 74, decoder 75, and gates 76 and 77. The translation controller 8 receives signals and data from the CPU 10, and outputs a number of different signals including access addresses for accessing the TRAM 72, a CPU access signal received from the CPU 10, a shift data signal SD to select the size of a block, a write signal WT to set the TRAM 72 to the write or read mode, and a through signal T to select the mode where data is not written into the TRAM 72 and address translations are not performed. The translation controller 8 reads data from the TRAM 72 via the bidirectional buffer 74 and sends the data to the CPU 10.

The lower 12 bits, i.e., $A_0$–$A_{11}$ of a 24-bit virtual address $A_0$–$A_{23}$ input to the address translator 7 are output as the lower 12 bits of a real address while the higher 12 bits, i.e., $A_{12}$–$A_{23}$ are used to define five groups of block addresses, each of which consisting of eight bits. The bits $A_{12}$–$A_{23}$ are directed to the input terminals 0–4 of the input selector 71 such that terminal 0 receives bits $A_{12}$–$A_{19}$, terminal 1 receives bits $A_{13}$–$A_{20}$, terminal 2 receives bits $A_{14}$–$A_{21}$, terminal 3 receives bits $A_{15}$–$A_{22}$, and terminal 4 receives bits $A_{16}$–$A_{23}$. The translation controller 8 also sends an 8-bit access address (virtual address) to the input terminal C of the input selector 71. Thus, the input selector 71 selects an 8-bit address either from the input terminal C or from one of input terminals 0–4 depending on the CPU access signal to the control terminal Sc.

The decoder 75 receives a 3-bit shift data from the translation controller 8 and decodes it into five signals ($S_0$–$S_4$) with one signal set to a logic 1. The signal with a logic level 1 indicates an input terminal to be selected. These five signals are input to the control terminals $S_0$–$S_4$ via the gate 76. At the same time, the translation controller 8 outputs the CPU access signal to the gate 76 and the control terminal Sc of the input selector 71.

When the CPU access signal selects the data at the input terminal C, gate 76 is closed. When the CPU access signal selects the data at the input terminals 0–4, gate 76 is open and the control signals $S_0$–$S_4$ are sent to the input selector 7 so that the data at one of the input terminals 0–4 is selected according to the control signals $S_0$–$S_4$.

Figure 4:
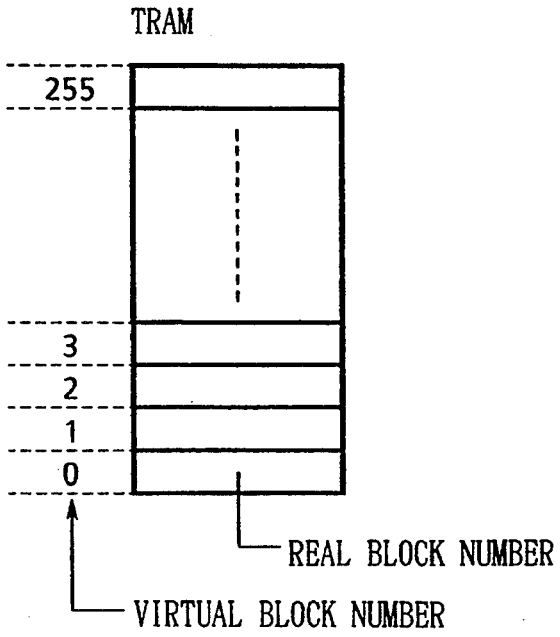
FIG. 4 illustrates the translation table of the embodiment.

As shown in FIG. 4, the TRAM 72 is a 256-byte SRAM and provides a translation table which outputs real block numbers corresponding to the virtual block numbers used to address the TRAM 72. The TRAM 72 is controlled by the write signal WT from the translation controller 8 to operate either in the write mode or in the read mode. When being written to, the TRAM 72 is accessed with the access addresses from the translation controller 8 to write a 1-byte real block number into the TRAM 72. When the TRAM is read from it, it is accessed with a virtual block number to read a 1-byte real block number from the TRAM 72. This 1-byte data is transmitted and received between the translation controller 8 and the TRAM 72 via the bidirectional buffer 74 and the direction of transmission is selected by the write signals WT.

The upper twelve bits of the virtual address, i.e., $A_{12}$–$A_{23}$ are input to the input terminals X of the output selector 73. The TRAM 72 outputs five signals to the input terminals 0–4 of the output selector 73, each terminal corresponding to one of five groups of block addresses as illustrated in FIG. 3. Bits $A_{12}$–$A_{15}$ of a 24-bit virtual address are also input as higher bits of an address within a block to the input terminals 1–4 of the output selector 73 such that terminal 1 receives bits $A_{12}$, terminal 2 receives bits $A_{12}$–$A_{13}$, terminal 3 receives bit $A_{12}$–$A_{14}$, and terminal 4 receives bits $A_{12}$–$A_{15}$, while at the same time logic level 0's are input as next higher bits to the real block addresses input to the terminals 0–3 of the output selector 73. The output selector 73 selects an 8-bit data from the terminal X under control of the through signal supplied to the control terminal Sx, and an 8-bit data from one of the terminals 0–4 according to control signals to the terminals $S_0$–$S_4$. In this manner, $A_{12}$–$A_{23}$, i.e., a 12-bit real address is output from the output selector 73.

The decoder 75 outputs the five signals ($S_0$–$S_4$) to the control terminals $S_0$–$S_4$ of the output selector 73 via the gate 77. The translation controller 8 outputs the through signal, which causes the gate 77 to close and the output selector 73 to select a 12-bit signal $A_{12}$–$A_{23}$ at the terminal X. When the translation controller 8 does not output the through signal, the gate 77 opens and the output selector 73 selects a 12-bit signal from one of the terminals 0–4 according to the control signals at the terminals $S_0$–$S_4$ of the output selector 73.

The size of a block is defined before any read, write, or editing operations are performed on waveforms in memory. Once the size of a block is set, the CPU 10 outputs data in accordance with the selected size of the block to the translation controller 8. The shift of the data determines which bits of a 24-bit input address supplied to the address translation 7 are to be used to define a block address.

The following description of the embodiment of the present invention assumes that a total of 256 blocks of one of the previously described five groups of block addresses has been defined in the waveform RAM 2. It is also assumed that the number of addresses in each of 256 blocks has been defined to be either 64 k, 32 k, 16 k, 8 k, or 4 k. Of course, another embodiment may have more than one group of blocks each of which may have a different number of addresses.

The CPU 10 performs three operation modes of the apparatus of the invention; the record mode where waveforms are recorded into the waveform memory, the reproduction mode where the waveforms in the waveform memory are reproduced, and the edit mode where the waveforms in the waveform memory are edited.

The translation table is not updated in the record mode and reproduction mode but is updated in the edit mode where waveforms are erased or relocated.

During the write process when data is written into the translation table in the TRAM 72, the CPU 10 instructs the translation controller 8 to output the CPU access signal to the input selector 71 and the write signal WT to the TRAM 72 so that it is set to write mode. The CPU 10 then outputs a virtual block number to the input selector 71 and sends the real block number via the bidirectional buffer 74 to the TRAM 72, thus writing the real block number that corresponds to the virtual block number.

During the real process when data is read from the TRAM 72 referenced by the CPU 10 with a desired virtual block number, the CPU 10 outputs the CPU access signal to the terminal Sc of the input selector 71 and disables the write signal WT to set the TRAM 72 to the read mode. The CPU 10 then outputs a desired virtual block number to the terminal C of the input selector 71 and reads the corresponding real block number from the TRAM 72 into the translation controller 8 via the bidirectional buffer 74.

During the write process when waveforms are written into the waveform RAM 2 via the transfer circuit 1 and during the read process when waveforms are read from the waveform RAM 2 via the PCM sound source 3, the CPU 10 disables the CPU access signal to the input selector 71 and disables the write signal WT so that the TRAM 72 is set to the read mode. The address translator 7 then receives a 24-bit virtual address, which is used to access the TRAM 72 to read the corresponding real block number from the TRAM 72. A 24-bit real address is finally output by the address translator 7 to access the waveform RAM 2.

Blocks in Waveform RAM and Translation Table in TRAM

The blocks defined in the waveform RAM 2 and the translation table in the TRAM 72 will be described below.

Figure 6A:
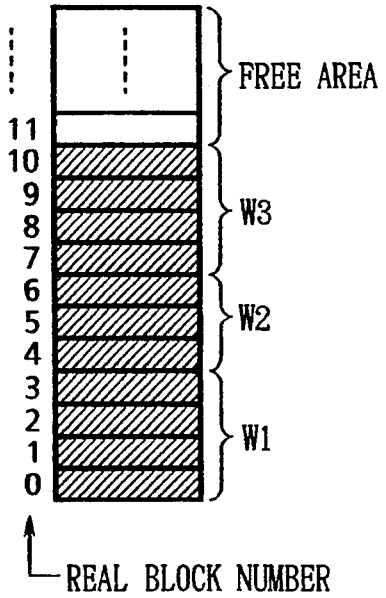
FIG. 6A illustrates waveforms W1, W2, and W3 recorded in the waveform memory.
Figure 7A:
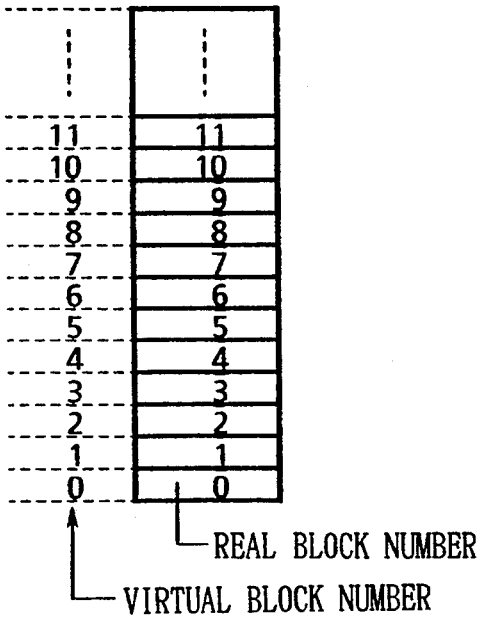
FIG. 7A illustrates the updated translation table that corresponds to FIG. 6A; where the waveform W1, W2, and W3 are shown.

Upon initialization, the virtual addresses and the real addresses are set the same. It is assumed that the three waveforms W1, W2, and W3 are stored consecutively beginning from real block number "0" as shown in FIG. 6A. It should be noted that the virtual addresses are the same as the real address as shown in FIG. 7A.

Figure 6B:
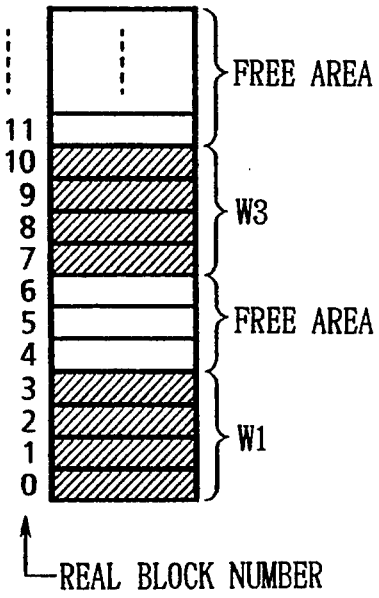
FIG. 6B illustrates remaining waveforms W1 and W3 after waveform W2 has been deleted from the waveform memory.
Figure 7B:
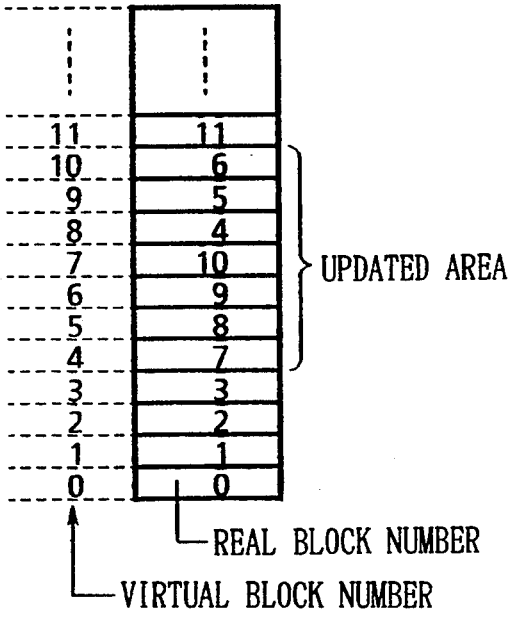
FIG. 7B illustrates the updated translation table of the embodiment that corresponds to FIG. 6B, where the waveform W1, W3, and a free area resulted from the deletion of waveform W2.

If waveform W2 is deleted as shown in FIG. 6B so that the memory area of block numbers 4–6 becomes free, then the virtual block numbers 4–7 now correspond to the real block numbers 7–10, as shown in FIG. 7B, which indicate the new memory area of waveform W3. Then, virtual block numbers 8–10 now correspond to the real block numbers 4–6 that indicate the new free area resulted from the deletion of waveform W2. In this manner, the translation table is updated so that the waveform data are still consecutive each of which corresponding to one of the consecutive virtual block numbers, and the free area follows immediately after the final waveform data.

Thus, the translation table allows access to the waveform RAM 2 with consecutive virtual addresses even when the RAM 2 has waveform data stored in non-consecutive memory positions. The translation table also allows the user to read waveform data from the waveform RAM 2 or to write a new waveform data into the waveform RAM 2, as if the waveform data is stored in consecutive real addresses.

Figure 5:
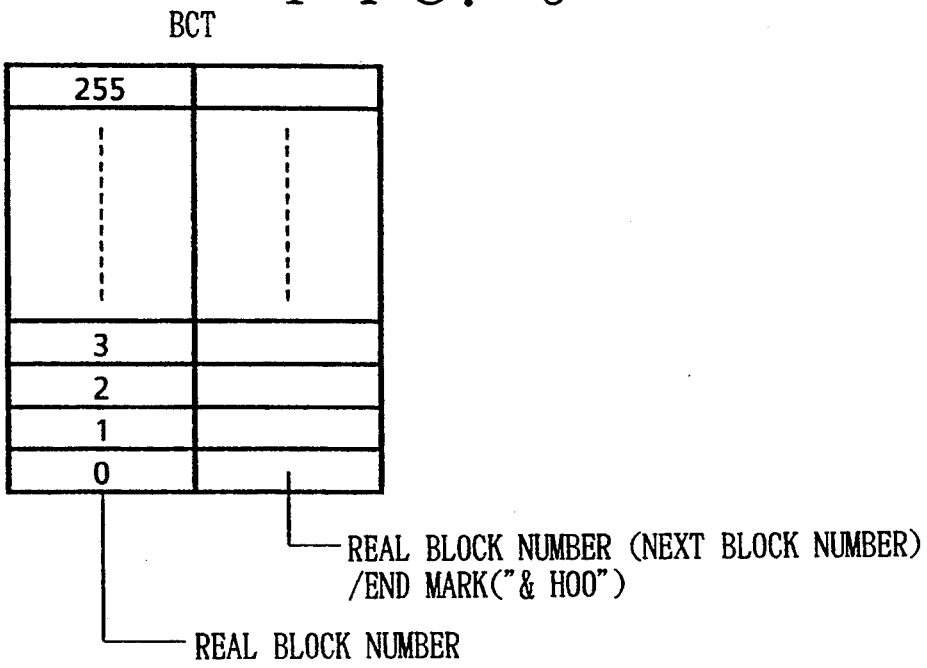
FIG. 5 illustrates the block chain table BCT of the embodiment.

In this embodiment, as shown in FIG. 5, a RAM 30 has a block chain table BCT that chains the blocks for respective waveform data together with the blocks in the free area in the waveform RAM 2. In the block chain table BCT, a real block number serves as an argument used to search the next real block number or an END data "&H00" indicative of the final block of a waveform. The block chain table BCT is updated when waveform data are erased, written to, or their order rearranged, and is referenced when the translation table in the TRAM 72 is updated.

Figures 8, 13:
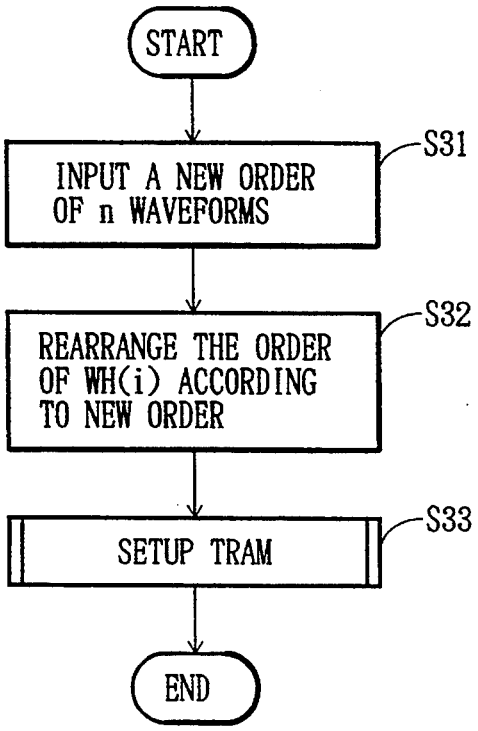
FIG. 8 illustrates an example of the block chain table BCT.
FIG. 13 is a flowchart illustrating the rearrangement of waveform data of the embodiment.

For example, when waveform data W2 is erased as shown in FIG. 6B, the block chain table BCT is updated as shown in FIG. 8. FIG. 8 illustrates the real block numbers updated after a waveform W2 has been deleted, with waveform W1 is in real block numbers 0–3 and waveform W3 in real block numbers 7–10. Real block number 6 of the free area points to real block number 11 as the next real block number in the free area so that the following free area is chained to the first location of free area when waveform W2 is deleted.

Figure 9:
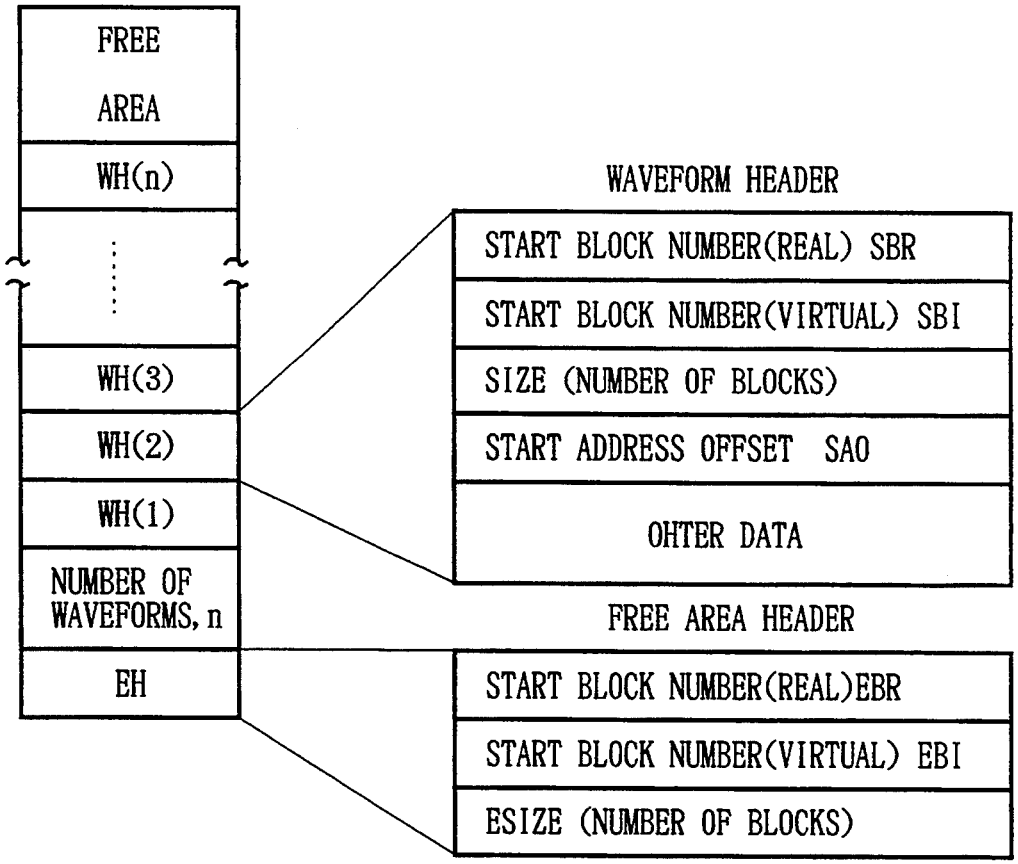
FIG. 9 diagrammatically illustrates a header of the embodiment.

The RAM 30 also has a header, where address information on the waveforms and free areas is stored, an example of which is illustrated in FIG. 9. The waveform header for waveform number i is indicated by WH(i) and holds real block number SBR, virtual block number SBI, SIZE, start address SAO, and other data. The real block number SBR indicates the start block of a group of blocks where the waveform i is stored. The virtual block number SBI indicates the number of the virtual block which corresponds to the real block number SBR. The SIZE indicates the number of blocks for the waveform data of waveform i. The address offset SAO indicates the number of addresses offset to the first address before the waveform actually starts in the start block. The SAO allows to store the start of the waveform a desired number of free addresses after the first address of the real block number. The number E of waveforms is also stored in the header. A Free area header EH contains the real block number EBR of the start block of the free area, virtual block number EBI which corresponds to this real block number EBR, and the number of blocks ESIZE in the free area.

Deletion of Waveform

The essential control preformed in an electronic musical instrument designed according to the embodiment of this invention will be described below. It is assumed that a plurality of waveform data have been stored in waveform RAM 2 and the initialization of the translation table has been performed.

The following labels represent respective registers and tables used for controlling the electronic musical instrument.

- i: waveform number or the register for holding waveform i.
- TRAM (x): memory area in the translation table addressed by a virtual block number x or a real block number stored in that memory area.
- BCT (x): memory area in the block chain table addressed by a real block address or the value stored in that memory area.
- CNT: counter for counting virtual block numbers.
- n: the number of waveforms.
- k: counter for counting from 1.

Figure 10:
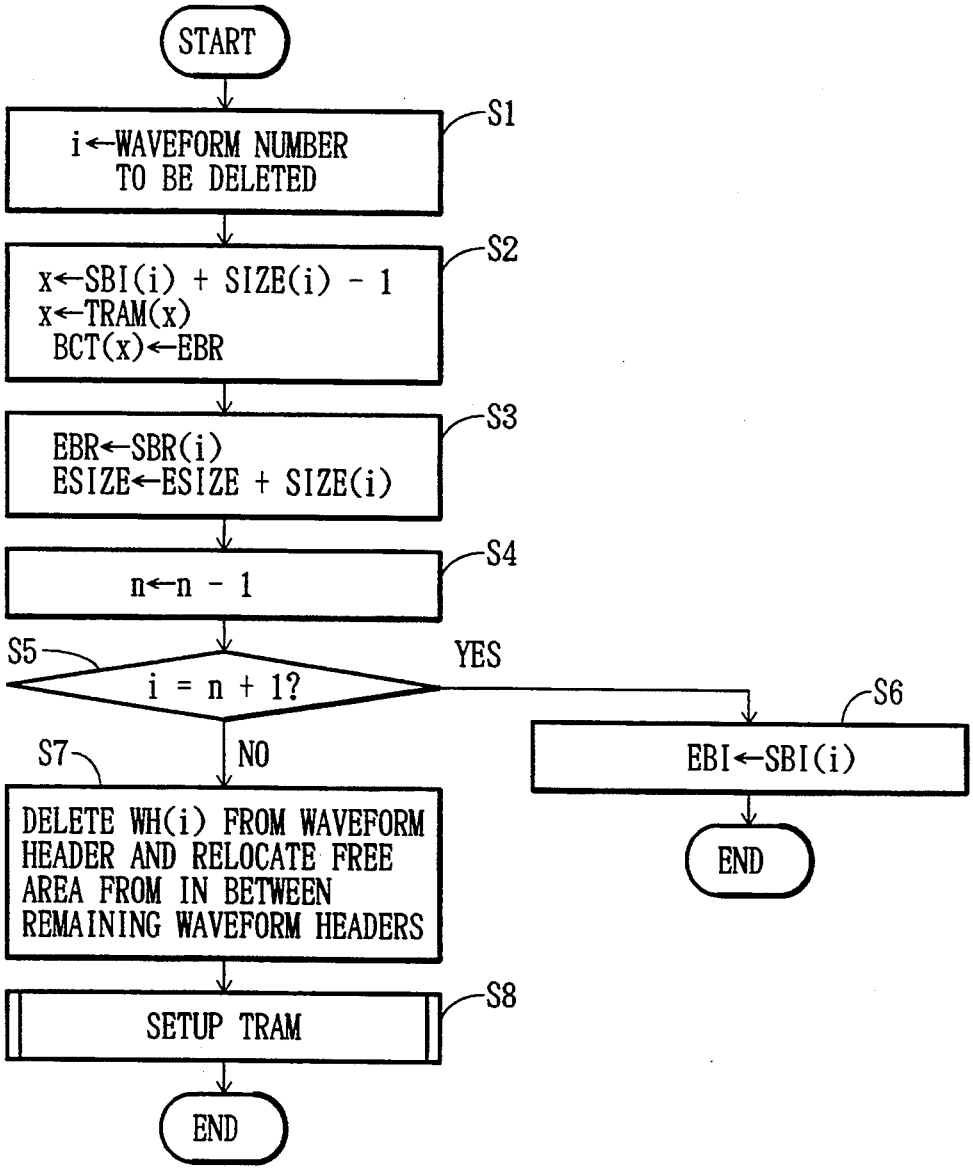
FIG. 10 is a flowchart illustrating the deletion of waveforms of the embodiment.

FIG. 10 is a flowchart illustrating steps for deleting an unnecessary waveform. At step 1, the user enters the number of waveform to be deleted via the panel switch 50. During step 2, the CPU 10 calculates the virtual block number of the final block of waveform data Wi by an equation SBI(i)+SIZE(i)-1 and loads it into a register x. The CPU 10 then reads the real block number TRAM(x) that matches the contents of the register x from the TRAM 72, and loads it into the register x. Thus, the content of the register x is now the real block number x. Then, the CPU 10 reads the real block number EBR of the start block of the current free area from the free area header EH, and loads it into the memory area in the block chain table BCT that matches the real block number x.

In this manner, the block chain table BCT is updated so that the final block of the free area resulted from deletion of waveform Wi is chained to the start block of the free area before waveform Wi is deleted.

In step. 3, the CPU 10 loads the real block number SBR(i) of the start block of waveform Wi, as the real block number of the start block of the free area, into the EBR of the free area header EH. The CPU 10 then adds SIZE(i) of the free area resulted from the deletion of waveform Wi to the ESIZE of the free area before waveform Wi is deleted, and stores the sum in ESIZE. During step 4, the number n of waveforms is decreased by 1, and waveform Wi is erased.

During step 5, a check is made to determine whether i=n+1. If the answer is YES, it indicates that the waveform data matching the final virtual address has been deleted. The flowchart proceeds to step 6 where the virtual block number SBI(i) for the top block of the waveform Wi is stored as the virtual block number EBI for the start block of the free area.

If the check made during step 5 is negative, it indicates that the waveform data exists at virtual addresses after the addresses where waveform Wi used to be. The flowchart proceeds to step 7 where waveform header WH(i) is deleted from the RAM 30 and then the remaining waveform headers WH(i+1), WH(i+2), . . . etc. are relocated to lower memory positions, while the segments of free area are relocated from in between these waveform headers to higher memory positions. During step 8 the TRAM is setup according to the procedure outlined in the flowchart in FIG. 11 to update the translation table so that waveform data WH(i+1), WH(i+2), . . . etc. have smaller virtual block numbers than the free area resulted from the deletion of waveform Wi.

Setup of TRAM

Figure 11:
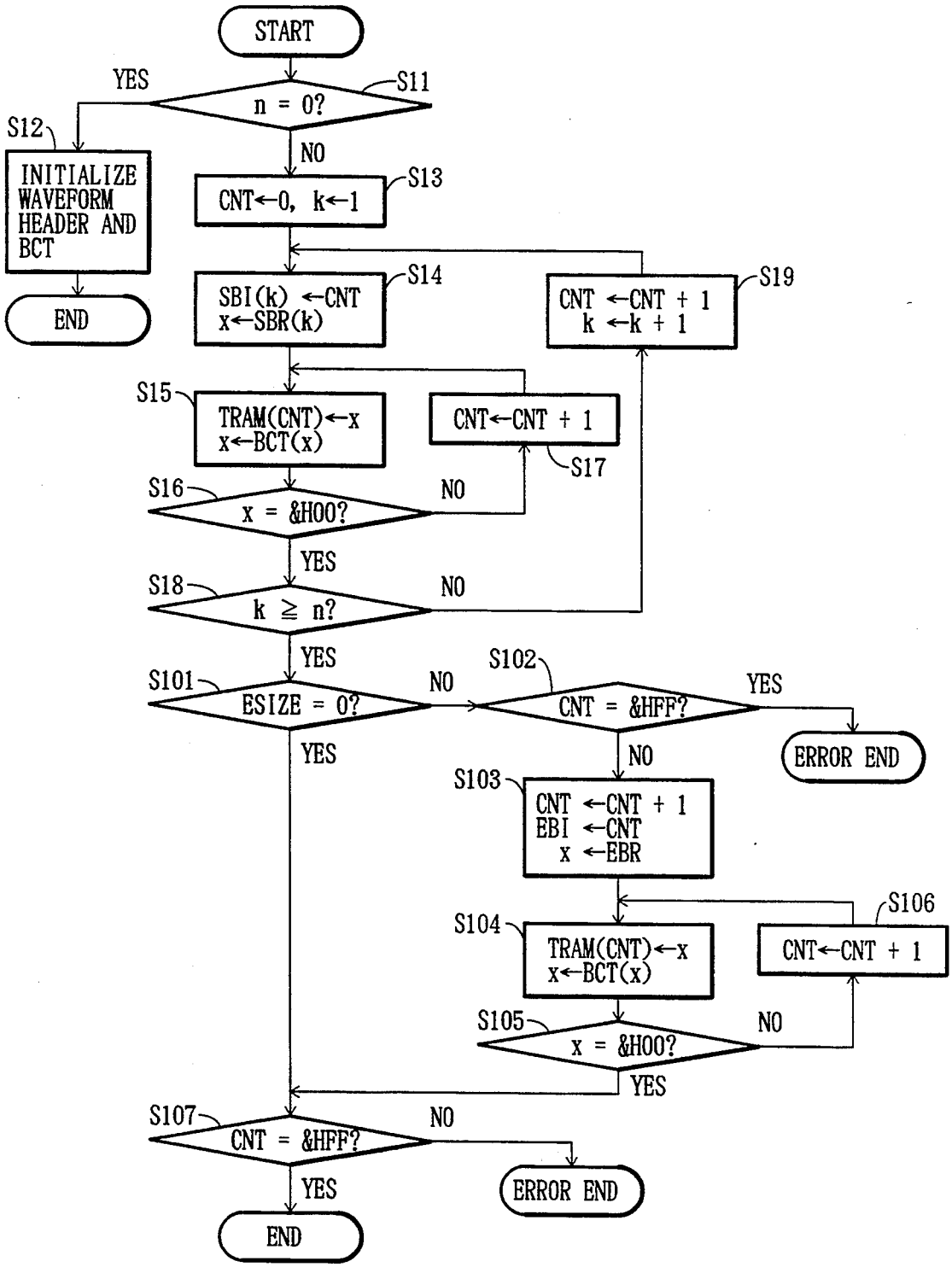
FIG. 11 is a flowchart illustrating the setup of the TRAM of the embodiment.

FIG. 11 illustrates the setup of the TRAM in detail. A check is made to determine whether n=0 at step 11. If the answer is YES, it indicates that all of the waveform data has been deleted. The flowchart proceeds to step 12 where the waveform header and the block chain table BCT are initialized and the TRAM setup process is complete. If the check made during step 11 is negative, it indicates that all of the waveform data has not yet been deleted. The flowchart proceeds onto step 13 where the counter CNT of virtual block number is cleared to "0" and the counter k of waveform number is set to "1".

The flowchart proceeds on to step 14 where the translation table in TRAM 72 is updated by the counter CNT that counts from 0 up to 255. Steps 14–18 are iterated for each of a total of n waveforms by incrementing the values of the counter k and the counter CNT in step 19. Step 15 is iterated for each of the blocks of a waveform data while the counter CNT is incremented at step 17 after a determination at step 16.

Step 14 is a processing for the start of respective waveform where the current content of the counter CNT is stored as virtual block number SBI(k) of the start block of waveform k into waveform header WH(k) and the real block number SBR(k) of the start block is stored into register x, thereby updating the virtual block number indicative of the start block of waveform k as well as loading into register x the real block number to be written into the translation table in step 15. This real block number loaded into register x is also used to reference the BCT in step 15.

In Step 15 the contents of register x is stored in the memory area at TRAM(CN) in the translation table. The CPU 10 references the block chain table BCT with the contents of register x to store BCT(x) into register x. Step 15 is iterated with counter CNT incrementing by one for each loop until the final block is reached at step 16, where the value of x is checked to determine whether or not x=&H00. The translation table is updated so that the consecutive virtual block number starting at SBI(k) matches the real block number chained after the real block number SBR(k) of the start block of the waveform k.

After the translation table has been updated for each waveform, a check is made to determine whether k≧n at step 18. If the answer is YES at step I8, it indicates that the translation table has been updated for all the waveforms stored in the waveform RAM 2. The flowchart then proceeds to step 101.where a check is made to determine whether ESIZE=0. If the answer at step 101 is YES, it indicates that there is no free area left and the flowchart proceeds to step 107. If the answer at step 101 is NO, the flowchart proceeds onto step 102. At step 102 a check is made to determine whether CNT=&HFF.

If the answer is YES at step 102, it indicates that there still is a free area after the search has reached final virtual block number. This is an error and corrective error processing is performed accordingly. If the answer is NO at step 102, free area processing is performed for the block numbers in the free area from steps 103 onward. In step the CPU 10 increments the counter CNT and stores the incremented content of the counter CNT as the virtual block number EBI of the start block of the free area to the free area header EH, and stores the real block number EBR of the start block of the free area to the register x, thus updating the virtual block number of the start of the free area. Steps 104, 105, and 106 correspond to steps 15, 16, and 17 in that the translation table is updated so that the real block numbers chained by the BCT in order beginning from EBR at the start of the free area, correspond to the virtual block numbers beginning at EBI.

Step 107 corresponds to step 102 where a process is performed in the event of an error. If the answer at step 107 is YES, it indicates that no free area after step 101 is available, or that the processing of the free area was completed at step 105 and the final virtual block number has been reached. If the answer is NO at step 107, it indicates that the final virtual block number has not been reached after completion of the processing of the free area at step 105. This is an error and corrective error processing is performed accordingly.

Although the waveform RAM 2 has some free areas resulting from the deletion of old waveform data from the existing waveform data, the waveform RAM 2 can be addressed with consecutive virtual addresses as if block numbers of the remaining waveform data as well as the free area are consecutive in terms of virtual block number and the free area is chained to the final waveform data.

This allows a new waveform data which is consecutive by nature to be written into free areas which are not consecutively located in terms of real addresses, by referencing the virtual block number EBI of the start block stored in the free area header EH and simply accessing the waveform RAM 2 with the corresponding virtual block number.

This also allows waveform data stored at non-consecutive real addresses in the memory area to be read by referencing the virtual block number SBI of the start block stored in the waveform header WH and to simply access the waveform RAM 2 with the virtual block numbers.

Writing of Waveform Data

Figure 12:
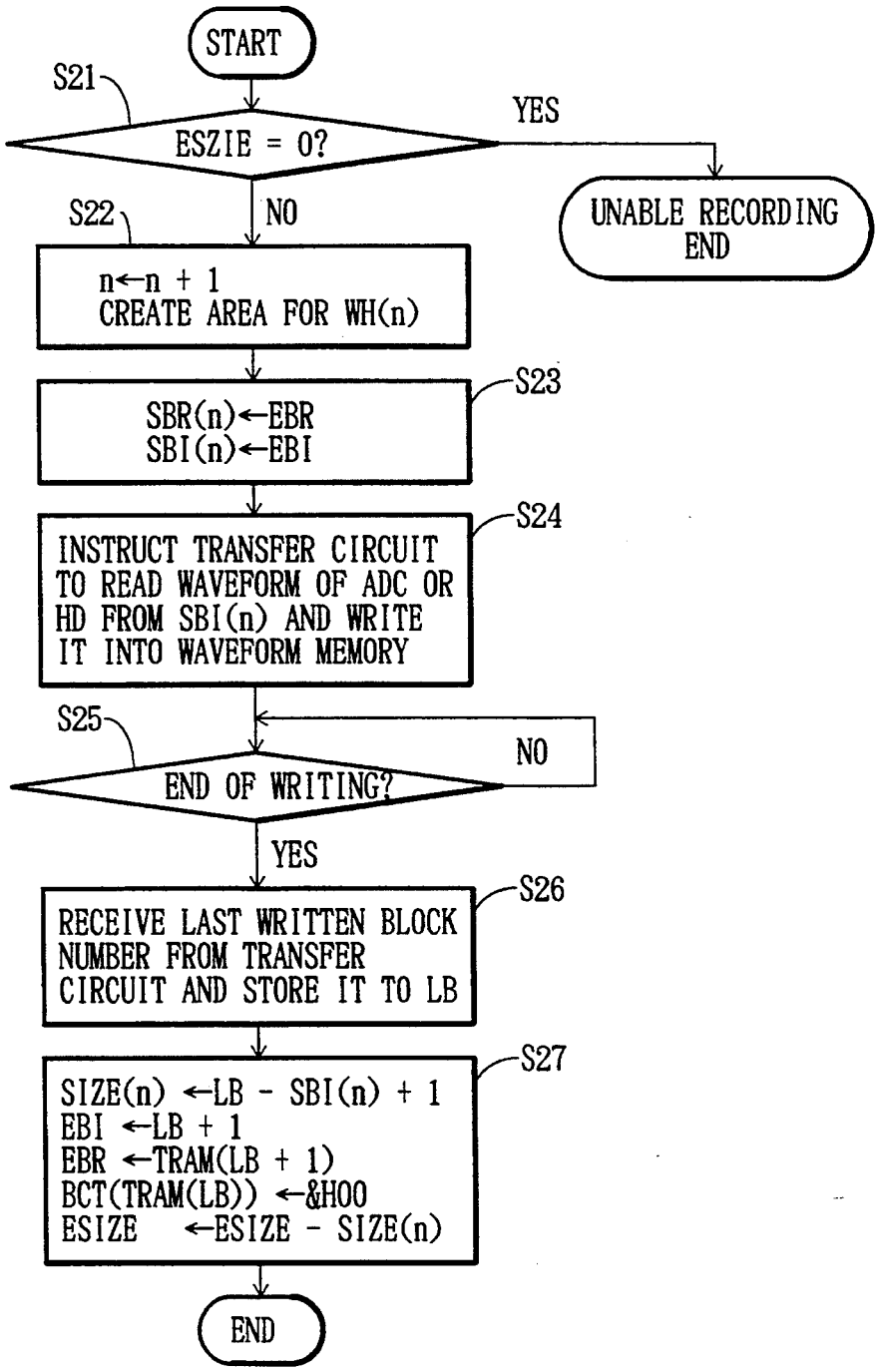
FIG. 12 is a flowchart illustrating the write processing of the embodiment.
Figure 14A:
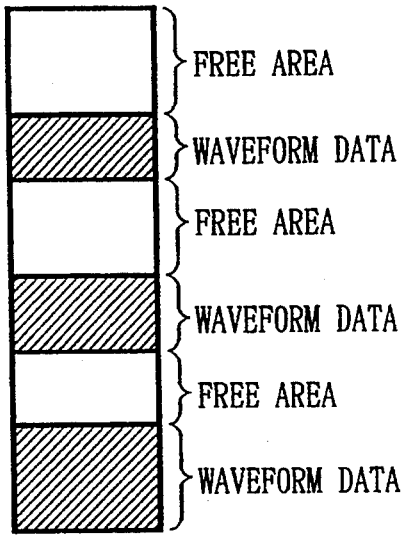
FIGS. 14A and 14B illustrate the subject to be solved by the present invention.
Figure 14B:
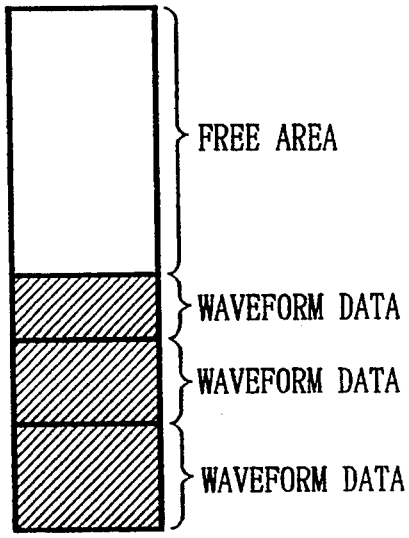

FIG. 12 is a flowchart illustrating the writing of a waveform data. At step 21 the value of ESIZE is checked to determine whether ESIZE=0. If the answer is YES, it indicates that there is no free area when this is the case, the write process is halted and a portion of the memory must be erased before new data or waveforms can be written. If the answer is NO the process proceeds to step 22 where the number n of waveforms is incremented by 1. A new waveform header WH(n) for the new n in the header is also created at step 22.

During step 23, the CPU 10 stores the real block number EBR for the start of the free area into the new waveform header WH(n) as the real block number SBR(n) and stores the virtual block number EBI for the start of the free area into the virtual block number SBI(n).

At step 24, the CPU 10 selects the source from which the transfer circuit 1 obtains the waveform data to be written into the waveform RAM 2. The waveform data is obtained from the A/D converter 5 or a hard disk 100 and is written to the waveform RAM 2 starting at an address indicated by the virtual block number SBI(n). In step 25 a check is made to determine whether all of the waveform data have been written into the waveform RAM 2. If the answer at step 25 is YES, the CPU 10 receives the final block number of the blocks just written from the transfer circuit 1 and stores it into a register LB.

In step 27, the CPU 10 calculates the number of blocks necessary to store waveform data just written according to the equation LB-SBI(n)+1 and stores it as SIZE(n) in the waveform header WH(n). The CPU 10 also stores the virtual block number LB+1 and real block number TRAM(LB+1) of the free area as EBI and EBR, respectively, into the free area header EH. The CPU 10 then writes "&H00" into the BCT(TRAM(LB)) location that corresponds to the final block of the waveform data just written. Finally, the CPU 10 calculates the new value of ESIZE by the equation ESIZE-SIZE(n) and stores it into the free area header EH. The value of the new ESIZE is less by the number of blocks used to hold the waveform data just written.

Rearrangement of Waveform data

FIG. 13 is a flowchart illustrating the rearrangement of the waveform data in the memory. At step 31, the CPU 10 detects that the panel switch 50 was operated by the user and then inputs the new order of the waveform data. In step 32, the order of the waveform headers WH(i) is rearranged in the header. During step 33, the setup of the TRAM as illustrated in FIG. 11 is performed in order to update the translation table so that the virtual block numbers and the real block numbers correspond to the new order of the waveform data in the waveform RAM 2.

Thus, in the translation table within the TRAM 72, the real block numbers of both the waveform data and the free area correspond to consecutive virtual block numbers so that the last waveform data entry is immediately followed by free area. This allows new waveform data to be written at virtually consecutive free areas whose real addresses are actually not consecutively located in the waveform RAM 2.

What is claimed is:

1. A musical sound signal recording/reproducing apparatus for recording/reproducing musical sound signals having a plurality of waveforms, comprising:

a rewritable waveform memory for storing waveform data of musical sound signals, said rewritable waveform memory being accessed with real addresses to write and read said waveform data; and address translating means for translating consecutive virtual addresses supplied thereto into said real addresses, such that enabling an access of a waveform data in said rewritable waveform memory with consecutive virtual addresses even if said waveform data is divided into plural parts and said plural parts are respectively stored in plural areas which are not consecutive to each other in said rewritable waveform memory.

2. The musical sound signal recording/reproducing apparatus according to claim 1 further includes updating means for updating said address translating means when one waveform data is deleted from said rewritable waveform memory, such that a free area in the rewritable waveform memory resulting from the deletion of the one waveform data is consecutively followed in terms of virtual address by a free area before the one waveform data is deleted.

3. The musical sound signal recording/reproducing apparatus according to claim 1, wherein said rewritable waveform memory is divided into plural blocks each having consecutive real addresses and the translation from said virtual addresses to said real addresses is executed in the unit of said blocks.

4. The musical sound signal recording/reproducing apparatus according to claim+3, wherein each of said block includes same number of addresses therein, and the number is selectable.

5. The musical sound signal recording/reproducing apparatus according to claim 1, wherein each of said waveforms is stored in plural areas each of which has consecutive real addresses in said rewritable waveform memory, and is located with areas where other waveforms are stored therebetween.

6. The musical sound signal recording/reproducing apparatus according to claim 5, wherein said consecutive virtual addresses are translated by said translating means into real addresses of said plural areas in said rewritable waveform memory, whereby said real addresses might not be consecutive as a whole.

7. The musical sound signal recording/reproducing apparatus according to claim 1, wherein said address translating means include a translation table defined in a random access memory.

8. The musical sound signal recording/reproducing apparatus according to claim 7, further including;

producing means for producing said translation table so that each of said waveforms stored in said rewritable waveform memory could be accessed by consecutive virtual addresses respectively.

9. The musical sound signal recording/reproducing apparatus according to claim 8, further including delete means for deleting unnecessary waveform data from said rewritable waveform memory.

10. The musical sound signal recording/reproducing apparatus according to claim 8, further including write means for writing additional waveform data into said rewritable waveform memory.

11. The musical sound signal recording/reproducing apparatus according to claim 8, further including means for rearranging an order of said waveform data stored in said rewritable waveform memory.

12. The musical sound signal recording/reproducing apparatus according to claim 9, wherein said producing means renew said translation table when either one of deleting or writing or rearranging operation has been done.

13. The musical sound signal recording/reproducing apparatus according to claim 10, wherein said producing means renew said translation table when either one of deleting or writing or rearranging operation has been done.

14. The musical sound signal recording/reproducing apparatus according to claim 11, wherein said producing means renew said translation table when either one of deleting or writing or rearranging operation has been done.

15. The musical sound signal recording/reproducing apparatus according to claim 1, further comprising;

input means for inputting waveform data of musical sound signal; and writing means for writing said musical sound signal into said rewritable waveform memory by accessing with said virtual addresses.

16. The musical sound signal recording/reproducing apparatus according to claim 1, further comprising;

reading means for reading out said waveform data from said rewritable waveform memory by accessing with said virtual addresses; and sound generating means for generating musical sound signal corresponding to the read waveform data.

* * * * *